US009650734B2

(12) United States Patent
Elliott et al.

(10) Patent No.: US 9,650,734 B2
(45) Date of Patent: May 16, 2017

(54) PANTOGRAPH PROJECTION

(71) Applicant: Gammill, Inc., West Plains, MO (US)

(72) Inventors: Daniel Lee Elliott, West Plains, MO (US); Joseph Wesley Bauman, Cabool, MO (US); Bettilou Kenney Langford, Stockton, MO (US)

(73) Assignee: Gammill, Inc., West Plains, MO (US)

( * ) Notice: Subject to any disclaimer, the term of this patent is extended or adjusted under 35 U.S.C. 154(b) by 281 days.

(21) Appl. No.: 14/522,837

(22) Filed: Oct. 24, 2014

(65) Prior Publication Data

US 2016/0115631 A1 Apr. 28, 2016

(51) Int. Cl.

| | |
|---|---|
| ***D05C 5/02*** | (2006.01) |
| ***D05B 19/12*** | (2006.01) |
| ***D05B 19/08*** | (2006.01) |
| ***D05B 81/00*** | (2006.01) |

(52) U.S. Cl.

CPC ..... *D05B 19/12* (2013.01); *D05B 19/08* (2013.01); *D05B 81/00* (2013.01)

(58) Field of Classification Search

CPC ..... D05B 19/08; D05B 19/02; D05B 19/06; D05B 19/12; D05B 19/14

USPC ..... 112/475.19

See application file for complete search history.

(56) References Cited

U.S. PATENT DOCUMENTS

| | | | | |
|---|---|---|---|---|
| 5,095,835 | A * | 3/1992 | Jernigan | D05B 19/08 112/103 |
| 5,323,722 | A * | 6/1994 | Goto | G05B 19/4205 112/102.5 |
| 6,161,491 | A * | 12/2000 | Takenoya | D05B 19/02 112/102.5 |
| 6,792,865 | B2 * | 9/2004 | Brunet-Manquat | B41F 33/0036 101/129 |
| 7,212,880 | B2 * | 5/2007 | Mizuno | D05B 19/08 112/102.5 |
| 9,267,222 | B2 * | 2/2016 | Schnaufer | D05B 19/12 |
| 2013/0190916 | A1 | 7/2013 | Schnaufer | |

* cited by examiner

*Primary Examiner* — Tejash Patel
(74) *Attorney, Agent, or Firm* — Husch Blackwell LLP

(57) ABSTRACT

The present invention relates to a sewing machine, specifically a long-armed stitcher. The present invention includes a computer device that may store pantograph patterns therein. The data including the pantograph patterns may be sent to projection units associated with the sewing machine head of the long-armed stitcher. The projection units use projection elements to project the pantograph patterns on the fabric to be stitched, allowing an operator of the stitcher to trace the projected pattern with a needle associated with the sewing machine head. Measurement devices associated with the sewing machine head determine head movement and alter the projected pattern accordingly such that the needle of the sewing head may continue to follow the pantograph pattern despite the head having moved in order to trace the pattern.

13 Claims, 2 Drawing Sheets

PANTOGRAPH PROJECTION

BACKGROUND OF INVENTION

The present invention relates to sewing, and more particularly, to particular styles and techniques of sewing that incorporate decorative stitching such as quilting. A quilt is a type of blanket typically having three layers: a decorative top layer, a middle layer of insulating material, and a backing layer. "Quilting" refers to the technique of joining these layers by stitches or ties.

Traditional quilting was done by hand and was very labor intensive. The invention of the sewing machine changed that tradition. Quilting evolved from production of functional blankets by specialized artisans into a popular hobby enjoyed by many.

Modern quilts are typically made using a long-armed sewing machine, or stitcher, attached to a frame. The frame supports and holds the workpiece in place while the sewing machine moves along the frame with respect to the workpiece. A typical quilting apparatus illustrating the relationship between the workpiece, frame, and sewing machine is shown in US Published Patent Application 2013/0190916.

A common way to quilt today is to use what is known as pantograph patterns. Pantographs are a way to "trace" a pre-printed stitch pattern with the machine in order to stitch that pattern onto the fabric. This allows very consistent work to be completed with a much lower skill level required versus traditional hand-guided stitching alone.

This is normally accomplished by mounting a paper pattern on the rear of the table. A laser pointer is mounted to the rear portion of the stitcher head. The operator sets up the needle/thread at the front of the machine and then goes around to the rear of the table. Handles are provided at the rear of the machine head to allow the operator to move the head from the rear of the table. By "tracing" the paper pattern with the laser dot, the operator is able to reproduce the patterns from the paper template to the fabric being sewn.

Operating the stitcher using the aforementioned method has some drawbacks. For example, because the operator is operating the machine head from the rear of the machine, additional room at the rear of the table must be provided. Needing to operate the machine from the rear further may require that control devices and other equipment be placed at the rear of the head that would otherwise be unnecessary and may even be duplicative.

Operating the stitcher using pantograph methods known in the art may also be somewhat difficult. For example, it may be challenging to align paper patterns at the rear of the machine, and/or it may be difficult to align lasers for tracing the pantograph patterns. In attempting to align and position paper pantograph patterns, the paper patterns may become damaged or torn. Also, when using paper patterns, storing and keeping the patterns from being damaged can be difficult.

A solution to the above-described method is desired wherein the operator does not need to be positioned at the rear of the stitcher in order to operate the pantograph functions of the stitcher. The solution should use an alternative to paper pantograph patterns such that alignment is simpler, and patterns will not be damaged during positioning. The solution should also eliminate the need for attaching a laser for tracing the pantograph pattern so as to reduce the errors associated with misaligning the laser.

SUMMARY OF INVENTION

The present invention relates to a sewing machine, more specifically a long-armed stitching machine, or stitcher. The stitcher includes a sewing head that may further include a sewing machine used to quilt fabric. The present invention utilizes a mechanism for following a pantograph pattern that can be traced from the front of the stitcher using the needle and thread to trace the projected pattern directly. The mechanism does not require the use of a laser for tracing a projected pattern.

The present invention comprises a computer, tablet, or other computer device that may store pantograph patterns therein. One or more projection units may be mounted above the stitcher head on a mounting frame located above the stitcher at a front portion or they may be mounted to the stitcher head itself. The one or more projection units include projection elements that may be LCD, DLP, CRT, laser, or other projection element types.

The one or more projection units may be in electrical and/or data communication with the computer device of the present invention such that a pantograph pattern may be loaded from the computer device and transmitted to the one or more projection units such that the projection unit may display the pantograph pattern to be traced. By tracing the pantograph pattern with the needle and thread, the operator can ensure that the needle and thread at the front portion of the head produces the same pattern in front of and below the fabric. In operation, the projected pattern may be tied into measurement devices, for example encoders, associated with the computer device such that the measurement devices may determine head movement and continually adjust the pattern accordingly.

The computer device may control the projection units by sending data to be projected to the projection units. The computer device may receive feedback from the measurement devices to determine head movement and alter projected data accordingly such that the needle of the sewing head may continue to follow the pantograph pattern despite the head having moved in order to trace the pattern.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
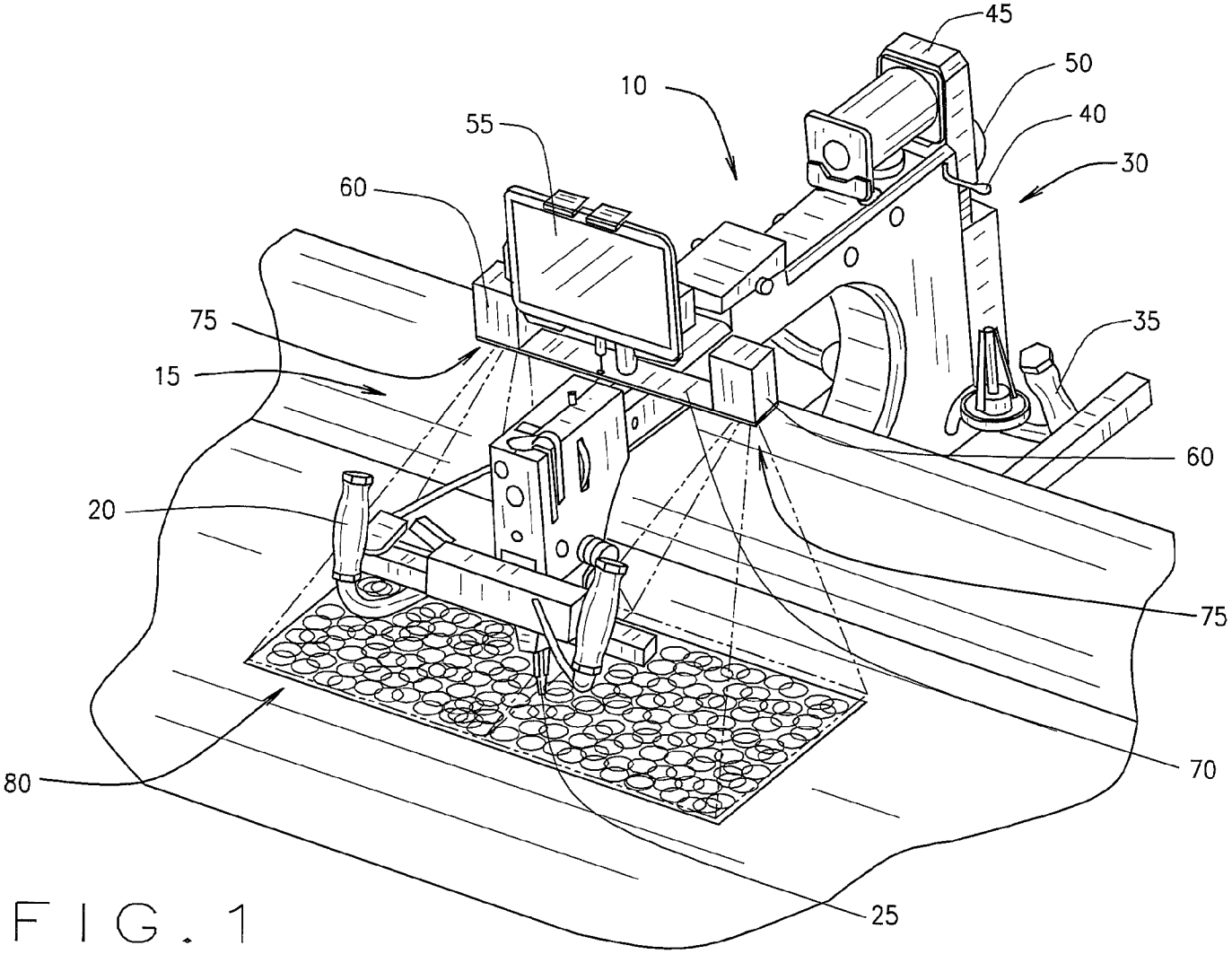
FIG. 1 is a perspective view of a sewing machine including projection units for projecting a pantograph pattern mounted to the sewing machine head according to the teachings of the present invention.
Figure 2:
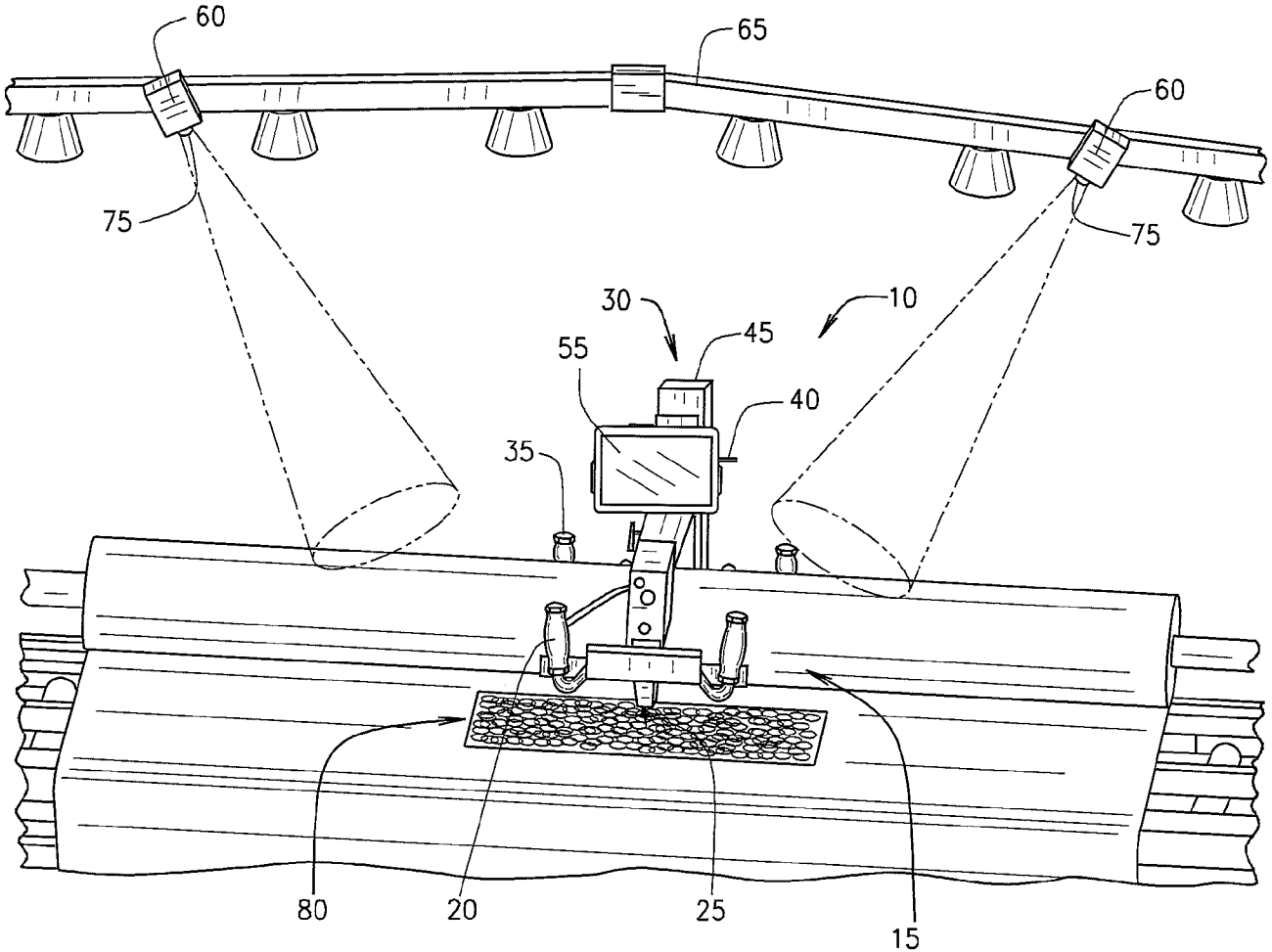
FIG. 2 is a perspective view of an alternative embodiment of the sewing machine of FIG. 1 wherein the projection units for projecting a pantograph pattern are mounted to a mounting member positioned and located above the sewing machine.

The present invention is directed generally toward a sewing machine including a means for projecting a pantograph pattern on quilt fabric such that the fabric including the pantograph pattern may be traced to stitch a pattern thereon. FIGS. 1 and 2 illustrate a perspective view of a sewing machine head 10 for use with a long-armed sewing machine, or long-armed stitcher. As illustrated, the sewing machine head 10 includes a plurality of components that are known in the art. For example, sewing machine head 10 includes a front portion 15 where a first set of handles 20 are positioned and located for moving the sewing machine head 10 above a quilt such that needle 25 may stitch a desired pantograph pattern onto the quilt positioned and located below the sewing machine head 10 in a long-armed stitcher arrangement known in the art.

At rear portion 30 of the sewing machine head 10, the sewing machine head 10 further may comprise a second set of handles 35 that are positioned and located for moving the sewing machine head 10 in order to trace a pantograph pattern positioned below the sewing machine head 10, thus ensuring that the needle 25 located at the front portion 15 of the sewing machine head 10 reproduces the pantograph pattern on a workpiece. In prior manners known in the art, the pantograph pattern may be traced by means of a laser (not illustrated) mounted to the rear portion 30 of the sewing machine head 10, for example to handles 35. Alternatively, it may be traced by a physical pointer (not illustrated), such as a rod or wire member, that is mounted in a similar manner.

FIG. 1 and FIG. 2 illustrate some components that are known in the art to be associated with sewing machine head 10. For example, FIG. 1 illustrates a thread guide 40, belt guard 45, and rear hand wheel 50.

FIG. 1 and FIG. 2 also illustrate a computer device 55. Computer device 55 of the illustrated embodiments is a personal computer (PC), though other alternatives are considered herein. For example, computer device 55 may be a tablet device (e.g., iPad, Android Tablet), a smartphone (e.g., iPhone, Android), or other computer device known or foreseeable in the art. In the illustrated embodiment, computer device 55 is in data communication with at least one projection unit 60 mounted on sewing machine head 10 via a Bluetooth connection. Other means of transmitting data to and from the computer device 55 and projection units 60 are contemplated herein, for example Wi-Fi transmissions. In the illustrated embodiment, sewing machine head 10 is associated with two projection units 60. Computer device 55 may store data associated with a plurality of pantograph patterns on a memory device as known in the art associated with computer device 55. A nearly limitless amount of data for pantograph patterns may be stored by computer device 55, and the data may be downloaded from the internet or other downloadable storage medium.

The projection units 60 may preferably be mounted to both sides of the sewing machine head 10, as illustrated in FIG. 1. There may be one projection unit 60 mounted to each side of the sewing machine head 10, such that there are two projection units 60 associated with sewing machine head 10. A pattern displayed by the projection units 60 may be split between each projection unit 60 such that they meet at the needle 25, or center line, of the head. By doing so, the sewing machine head 10 may create fewer shadows on the workpiece, and visibility of the pattern on the workpiece may be improved. Yet alternative embodiments may be used where the projection units 60 are instead mounted elsewhere on the sewing machine head 10. For example, as illustrated in FIG. 2, projection units 60 may be mounted to a mounting member 65 positioned and located above the sewing machine head 10. Mounting member 65 may be a light fixture, or it may be an alternative structure for use with sewing machine head 10.

Moreover, alternative embodiments may exist utilizing more or fewer projection units 60. In those embodiments, the projected pattern associated with each of projection units 60 should be able to be projected such that needle 25 may follow the projected pattern at or near a center line associated therewith.

In the embodiment illustrated in FIG. 1, each projection unit 60 is releasably attached to either side of sewing machine head 10 by a platform 70 and bolts and screws associated therewith (not illustrated). In the embodiment illustrated in FIG. 2, the projection units 60 are releasably attached to mounting member 65 by bolts and screws (not illustrated). In alternative embodiments, the means by which the projection units 60 are attached to sewing machine head 10 may vary.

Projection units 60 may include one or more projection elements 75 for projecting a pantograph pattern on the workpiece. In the preferred embodiment, the one or more projection elements 75 are one or more lasers for projecting a pantograph pattern on the workpiece, as a raster-type image will suffice to reproduce the pantograph pattern onto the workpiece positioned therebelow. As an alternative, the one or more projection elements 75 may be LCD, DLP, or CRT-type projection elements.

FIG. 1 and FIG. 2 illustrate an example of what a specific projected pantograph pattern 80 may look like to a user using needle 25 to stitch a pattern in the manner described herein. As illustrated, a user may operate needle 25 such that it traces projected pantograph pattern 80. When tracing projected pantograph pattern 80 with needle 25, the projected pantograph pattern 80 is also replicated on the workpiece itself. It should be noted that projected pantograph pattern 80 is but one illustrative example of a pantograph pattern that may be projected from projection units 60 via the one or more projection elements 75 and further traced by needle 25. In operation, a nearly limitless number of projected pantograph patterns may be used with the invention described herein as the pattern data may be stored within computer device 55 as described above. A user may select which pantograph pattern should be projected via a user interface known in the art and associated with computer device 55, though other known or foreseeable means are considered herein.

As an operator moves needle 25 to trace a pantograph pattern and thus produce the pattern on a workpiece, measurement devices (not illustrated) associated with sewing machine head 10 sense movements of sewing machine head 10 when the needle 25 is moved. The measurement devices may be positioned and located anywhere on or within sewing machine head 10 so long as they are able to accurately sense movement of sewing machine head 10 when the needle 25 is moved. The measurement devices are preferably encoders known commonly in the art, though in alternative embodiments, the measurement devices may be inertial (such as accelerometers), or optical. The movement that is sensed by the measurement devices may be transmitted as data to computer device 55, which may further be in communication with the measurement devices via a Bluetooth connection or other data connection known or foreseeable in the art. Computer device 55 may process the data received from the measurement devices regarding the movement of sewing machine head 10. Computer device 55 may then transmit data to projection units 60 to adjust the pantograph pattern being projected to track the movement of sewing machine head 10 such that the user is still following the pattern with needle 25 and thus reproducing the pattern on a workpiece. The aforementioned process may be repeated throughout the process of tracing a pattern and thus stitching a pattern on a workpiece until the process is complete. During the process, the measurement devices may repeatedly and continuously provide feedback to the computer device 55 to send signals to the one or more projection units 60 to adjust accordingly.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A system for projecting a pantograph pattern on a workpiece, the system comprising:

a computer device; and a sewing machine head in data communication with said computer device, said sewing machine head comprising a needle positioned and located for stitching said workpiece;

one or more projection units in data communication with said computer device for projecting said pantograph pattern on said workpiece, said one or more projection units each comprising one or more projection elements; and one or more measurement devices associated with said sewing machine head, wherein said one or more measurement devices are in data communication with said computer device for adjusting said pantograph pattern on said workpiece as said workpiece is stitched with said needle.

2. The system of claim 1, wherein the sewing machine head is in data communication with the computer device via a Bluetooth connection.

3. The system of claim 1, wherein the one or more measurement devices are encoders in data communication with the computer device via a Bluetooth connection.

4. The system of claim 1, wherein the computer device is a personal computer.

5. The system of claim 1, wherein the one or more projection elements is a laser element.

6. The system of claim 1, wherein the one or more projection units include two projection units.

7. The system of claim 6, wherein one projection unit is mounted to each side of the sewing machine head.

8. A method of stitching a workpiece, the method comprising:

sending pantograph pattern data from a computer device to one or more projection units associated with a sewing machine head of a long-armed stitcher, sending said pantograph pattern data to one or more projection elements associated with said one or more projection units;

projecting a pantograph pattern associated with said pantograph pattern data onto a workpiece, said pantograph pattern being projected by said one or more projection elements;

sensing movement of said sewing machine head relative to said pantograph pattern as a needle traces said pantograph pattern, said movement sensed by one or more measurement devices associated with said sewing machine head; and sending data regarding movement of said sewing machine head to said computer device, said one or more measurement devices transmitting said data regarding movement of said sewing machine head.

9. The method of claim 8, wherein sending the pantograph pattern data from the computer device to the one or more projection units is sent via a Bluetooth connection.

10. The method of claim 8, the one or more projection units comprising two projection units, wherein one projection unit is mounted to each side of the sewing machine head.

11. The method of claim 8, further comprising the computer device sending a signal to adjust the one or more projection units in response to data gathered from the one or more measurement devices.

12. The method of claim 8, the method repeating itself until a user has completed stitching the pantograph pattern onto the workpiece.

13. The method of claim 8, further comprising a user selecting the pantograph pattern to be projected on a workpiece via a user interface associated with the computer device.

* * * * *